US005768766A

United States Patent [19]

Hatagishi et al.

[11] Patent Number: 5,768,766

[45] Date of Patent: Jun. 23, 1998

[54] PRESS-CONNECTING TOOL

[75] Inventors: Yuji Hatagishi; Takayoshi Hirakawa, both of Shizuoka, Japan

[73] Assignee: Yazaki Corporation, Tokyo, Japan

[21] Appl. No.: 880,497

[22] Filed: Jun. 23, 1997

Related U.S. Application Data

[63] Continuation of Ser. No. 642,513, May 3, 1996, abandoned.

[30] Foreign Application Priority Data

May 12, 1995 [JP] Japan ..... 7-114748

[51] Int. Cl.[6] ..... H01R 43/01; H01R 43/04; H01R 4/24

[52] U.S. Cl. ..... 29/753; 29/33 M; 29/751; 29/755; 29/866; 72/409.14

[58] Field of Search ..... 29/33 M, 751, 29/753, 761, 861, 863, 865, 866, 755; 72/409.14, 413, 712

[56] References Cited

U.S. PATENT DOCUMENTS

| | | | |
|---|---|---|---|
| 4,385,794 | 5/1983 | Lucius | 439/399 |
| 4,991,289 | 2/1991 | French | 29/363 |
| 5,127,153 | 7/1992 | Mitra | 29/753 |
| 5,290,410 | 3/1994 | Takenami et al. | 29/753 |
| 5,500,999 | 3/1996 | Yagi et al. | 29/751 X |

FOREIGN PATENT DOCUMENTS

| | | | |
|---|---|---|---|
| 1298076 | 5/1962 | France | 29/753 |
| 41184 | 2/1989 | Japan | 29/363 |
| 4-48569 | 2/1992 | Japan | 29/753 |

*Primary Examiner*—Peter Vo
*Attorney, Agent, or Firm*—Morgan, Lewis & Bockius LLP

[57] ABSTRACT

There is provided a press-connecting tool by which the deformation of a sheath of a wire, as well as the loosening of a conductor of the wire, is prevented at the time of the press-connecting operation so as to keep the conductor in good contact with a press-connecting blade, thereby increasing a wire holding force and also stabilizing a contact resistance. In the press-connecting tool of the invention, a pair of opposed crush prevention walls for preventing the wire from being crushed in the press-connecting direction during the press-connecting operation extend downwardly from each of opposite lower ends of the arcuate pressing portion. The crush prevention walls and the arcuate pressing portion, which jointly form a wire pressing groove for receiving the wire, can contact a sheath of the wire at least over a half of an outer peripheral length of the sheath.

12 Claims, 6 Drawing Sheets

PRESS-CONNECTING TOOL

This application is a continuation of application Ser. No. 08/642,513, filed May 3, 1996, now abandoned.

BACKGROUND OF THE INVENTION

1. Field of the Invention

This invention relates to a press-connecting tool having a press-connecting die by which a sheathed wire is press-fitted into a slot of a U-shaped contour in a press-connecting blade to be press-connected to this press-connecting blade.

2. Background

There are known various press-connecting tools used for press-connecting a wire, and one example thereof is disclosed in Unexamined Japanese Patent Publication No. 4-48569.

As shown in FIG. 9, the known press-connecting tool 51 includes a press-connecting die 52, a sheathed wire 3, and a press-connecting blade 5 having a slot 4 of a U-shaped contour.

More specifically, an arcuate pressing portion 56 of an arcuate cross-section is formed at the end of the press-connecting die 52 facing in the press-connecting direction, and extends along the length of the wire to be pressed. A relief groove 57 for receiving the press-connecting blade 5 is formed in the press-connecting die, and is disposed perpendicularly to the arcuate pressing portion 56. A slot-fitting, arcuate pressing portion 58 of a narrower width is formed at the portion of the arcuate pressing portion 56 intersecting the relief groove 57.

In the above construction, first, the wire 3 is placed on the edge of the U-shaped slot 4 of the press-connecting blade 5 as shown in FIG. 10, or on the arcuate pressing portion 56 of the press-connecting die 52, and then the press-connecting die 52 and the press-connecting blade 5 are moved toward each other in the press-connecting direction. Then, the wire 3 is pressed into the U-shaped slot 4 by the arcuate pressing portion 56, and therefore a sheath 12 is cut, so that a conductor 13 is brought into contact with the press-connecting blade 5, thereby press-connecting the wire 3 to the press-connecting blade 5, as shown in FIG. 11.

At this time, the press-connection portion of the wire 3 is positively press-connected to the U-shaped slot 4 since the slot-fitting, arcuate pressing portion 58 is formed on the press-connecting die 52.

In the above conventional press-connecting tool, however, since the length of the arc of the arcuate pressing portion 56 is smaller as compared with the outer diameter of the wire 3, the sheath of the wire 3 is expanded in a direction perpendicular to the press-connecting direction at the time of the press-connecting operation. Additionally, the conductor becomes loose, and a gap is formed between the conductor and the sheath, so that the good press-connecting condition is not achieved, and the wire holding force is reduced, and the resistance of contact between the conductor and the press-connecting blade 5 becomes unstable.

Furthermore, it is necessary to provide a support pillar 59 which supports the slot-fitting, arcuate pressing portion 58 from the back side, and much time and labor are required for forming the relief groove 57 while leaving this support pillar 59. Particularly when the press-connecting die 52 is formed by cutting a metal material, there is encountered a problem that such a machining process is complicated, and increases the cost.

SUMMARY OF THE INVENTION

With the above problems in view, it is an object of this invention to provide a press-connecting tool by which the deformation of a sheath of a wire, as well as the loosening of a conductor of the wire, is prevented at the time of the press-connecting operation so as to keep the conductor in good contact with a press-connecting blade, thereby increasing the wire holding force and also stabilizing the contact resistance.

The above object of the invention has been achieved by a press-connecting tool including a press-connecting die which has an arcuate pressing portion for pressing a wire which arcuate pressing portion is formed at that end of the die facing in a press-connecting direction, the arcuate pressing portion extending along a length of the wire, and the press-connecting die having a relief groove for receiving a press-connecting blade when press-connecting the wire, in which the wire can be fitted into a slot of a U-shaped contour in the press-connecting blade, thereby press-connecting the wire to the press-connecting blade; a pair of opposed crush prevention walls for preventing the wire from being crushed in the press-connecting direction during the press-connecting operation extend downwardly from each of opposite lower ends of the arcuate pressing portion; and the crush prevention walls and the arcuate pressing portion, which jointly form a wire pressing groove for receiving the wire, can contact a sheath of the wire at least over a half of an outer peripheral length of the sheath.

Preferably, the distance between lower ends of the pair of opposed crush prevention walls is substantially equal to an outer diameter of the wire, and a depth of the wire pressing groove is not less than a half of the outer diameter of the wire.

Preferably, the distance between lower ends of the pair of opposed crush prevention walls is larger than an outer diameter of the wire, and a depth of the wire pressing groove is larger than a half of the outer diameter of the wire.

Preferably, a wire reception portion is provided at an intermediate portion of the slot in the press-connecting blade, and the wire reception portion has an arcuate pressing portion which can face the press-connecting die.

Preferably, guide portions for facilitating the insertion of the press-connecting blade into the relief groove in the press-connecting die are formed at that end of the relief groove facing in the press-connecting direction.

In the above press-connecting tool of the present invention, the pair of opposed crush prevention walls for preventing the wire from being crushed in the press-connecting direction during the press-connecting operation extend downwardly from each of opposite lower ends of the arcuate pressing portion, and the crush prevention walls and the arcuate pressing portion, which jointly form the wire pressing groove for receiving the wire, can contact the sheath of the wire at least over a half of the outer peripheral length of the sheath.

Therefore, during the press-connecting operation, the sheath of the wire is prevented from being crushed in a direction perpendicular to the press-connecting direction, and a conductor of the wire will not become loose, and therefore a gap will not develop between the sheath and the conductor, thus achieving a good press-connecting condition. Therefore, the wire holding force is increased, and also the resistance of contact between the conductor and the press-connecting blade is made stable.

The distance between the lower ends of the pair of opposed crush prevention walls is substantially equal to the outer diameter of the wire, and the depth of the wire pressing groove is not less than a half of the outer diameter of the wire. Therefore, the wire can closely fit in the wire pressing groove, and during the press-connecting operation, the wire sheath is positively prevented from being crushed in a direction perpendicular to the press-connecting direction.

Therefore, the conductor will not become loose, and therefore a gap will not develop between the sheath and the conductor, thus achieving the good press-connecting condition. Therefore, the wire holding force is further increased, and the resistance of contact between the conductor and the press-connecting blade is made more stable.

The distance between the lower ends of the pair of opposed crush prevention walls is larger than the outer diameter of the wire, and the depth of the wire pressing groove is larger than a half of the outer diameter of the wire.

Therefore, the press-connecting die can be easily disengaged from the wire after the press-connecting operation, and therefore the reduction of the wire holding force due to this disengagement resistance is prevented.

The wire reception portion is provided at an intermediate portion of the slot in the press-connecting blade, and the wire reception portion has the arcuate pressing portion which can face the press-connecting die. Therefore, the deformation of the wire in the press-connecting direction during the press-connecting operation is suppressed, and therefore the press-connecting blade and the conductor are kept in good contact with each other, and also the conductor is prevented from becoming loose.

The guide portions for facilitating the insertion of the press-connecting blade into the relief groove in the press-connecting die are formed at that end of the relief groove facing in the press-connecting direction. Therefore, the width of the relief groove can be decreased to reduce the gap between the press-connecting blade and the relief groove, and besides the provision of a slot-fitting, arcuate pressing portion is able to be omitted, and the manufacturing cost for the press-connecting tool can be reduced.

DESCRIPTION OF THE PREFERRED EMBODIMENTS OF THE INVENTION

Figure 1:
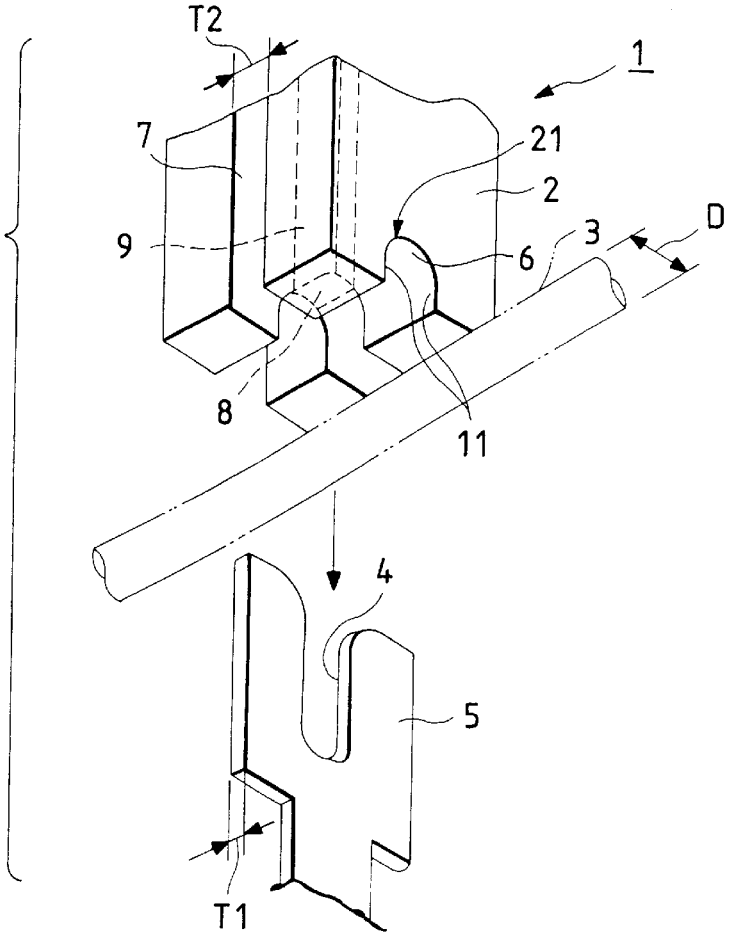
FIG. 1 is a perspective view of a first embodiment of a press-connecting tool of the invention.
Figure 2:
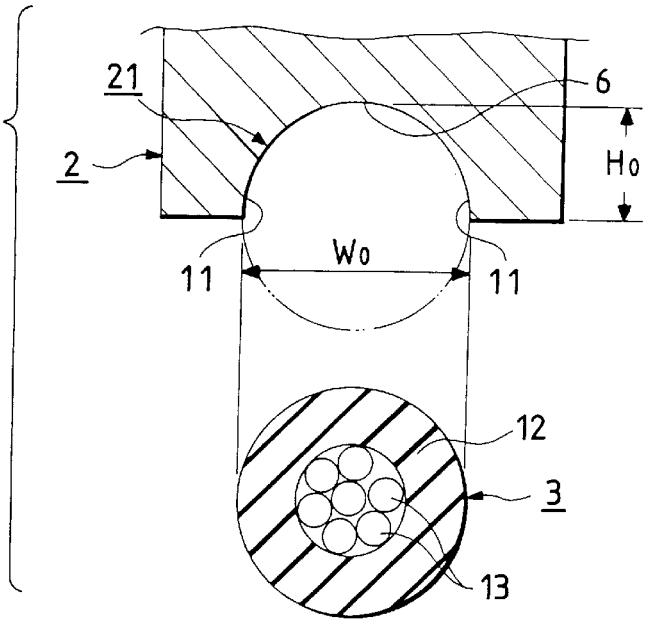
FIG. 2 is a cross-sectional view showing the configuration of a wire pressing groove in the press-connecting tool of FIG. 1.
Figure 3:
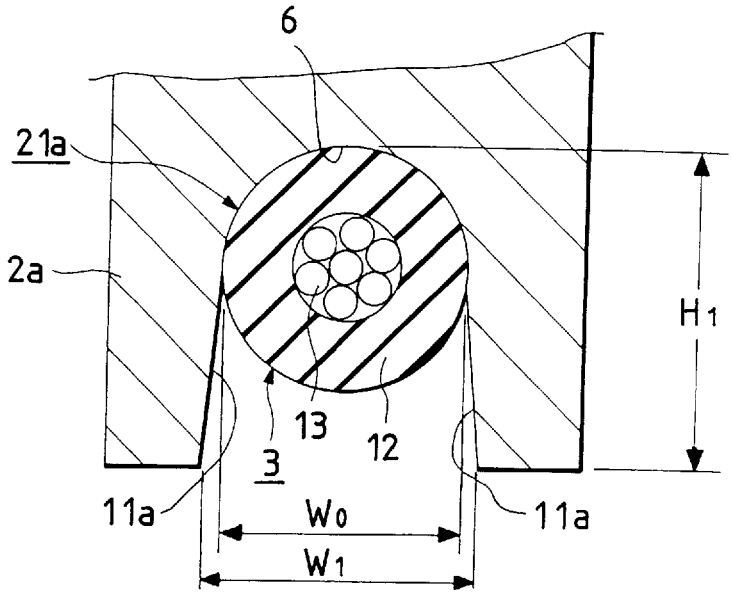
FIG. 3 is a cross-sectional view showing the configuration of a modified wire pressing groove.
Figure 4:
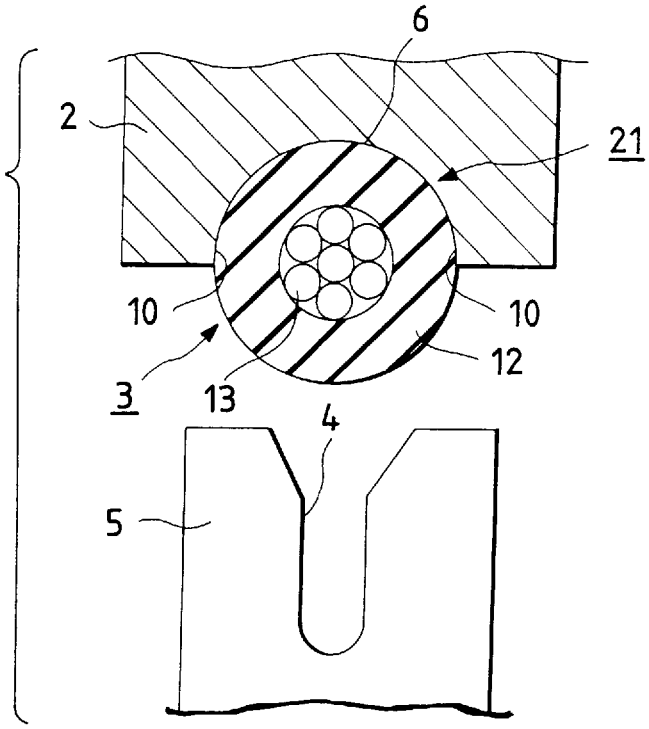
FIG. 4 is a view showing an intermediate stage of the press-connecting operation in the embodiment of FIG. 1.
Figure 5:
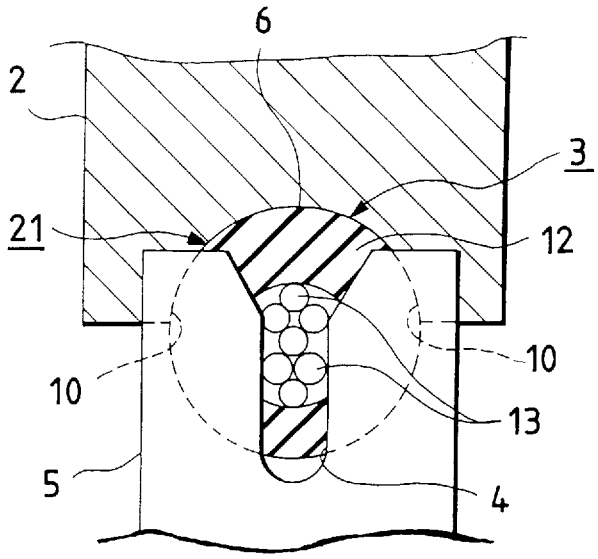
FIG. 5 is a view showing a condition in which the press-connecting operation is completed in the embodiment of FIG. 1.
Figure 6:
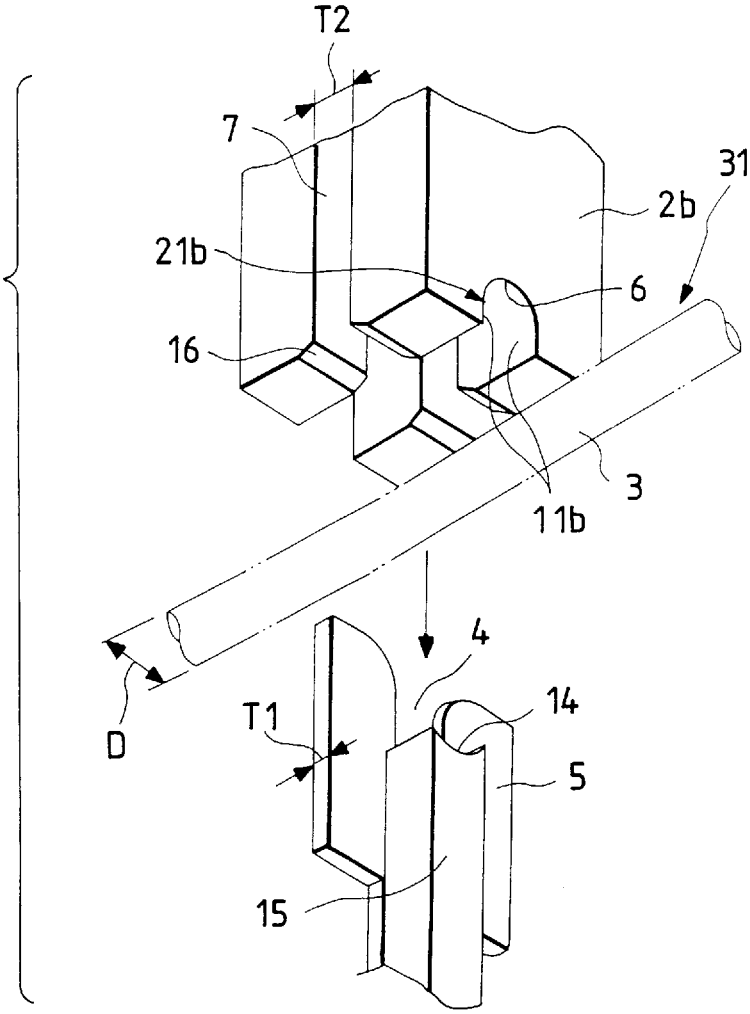
FIG. 6 is a perspective view of a second embodiment of a press-connecting tool of the invention.
Figure 7:
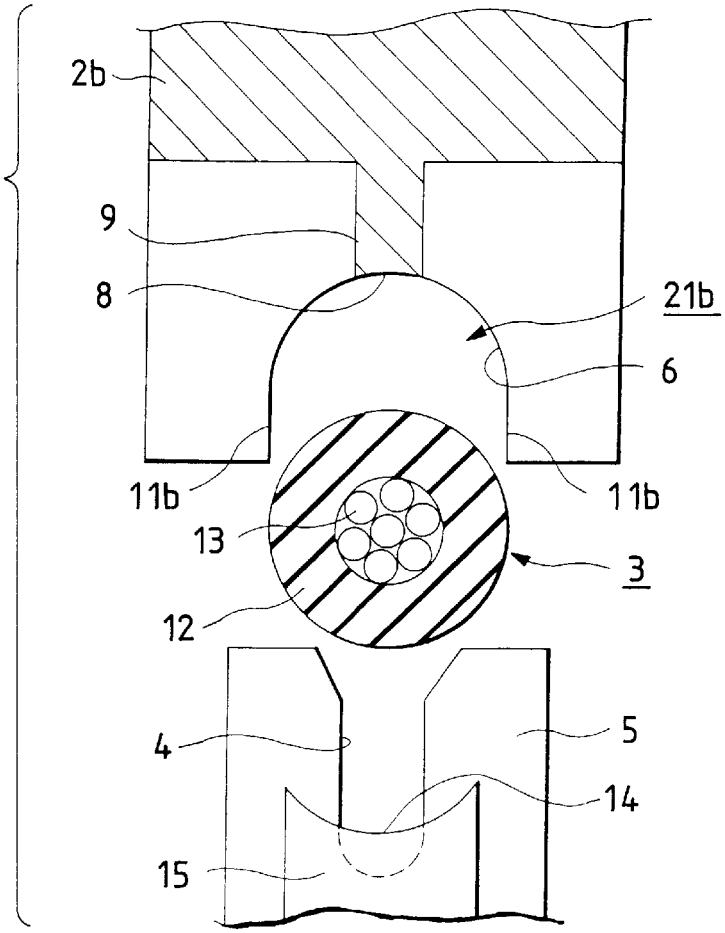
FIG. 7 is a view showing an intermediate stage of the press-connecting operation in the embodiment of FIG. 6.
Figure 8:
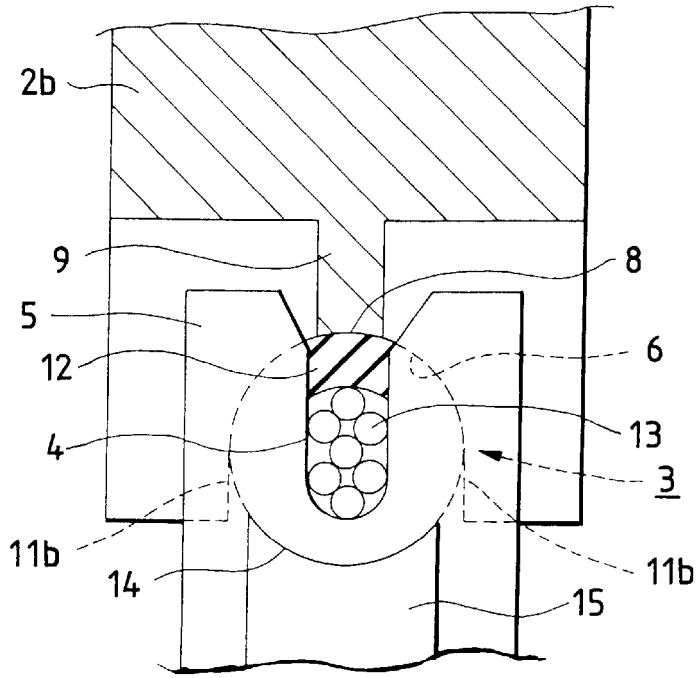
FIG. 8 is a view showing a condition in which the press-connecting operation is completed in the embodiment of FIG. 6.
Figure 9:
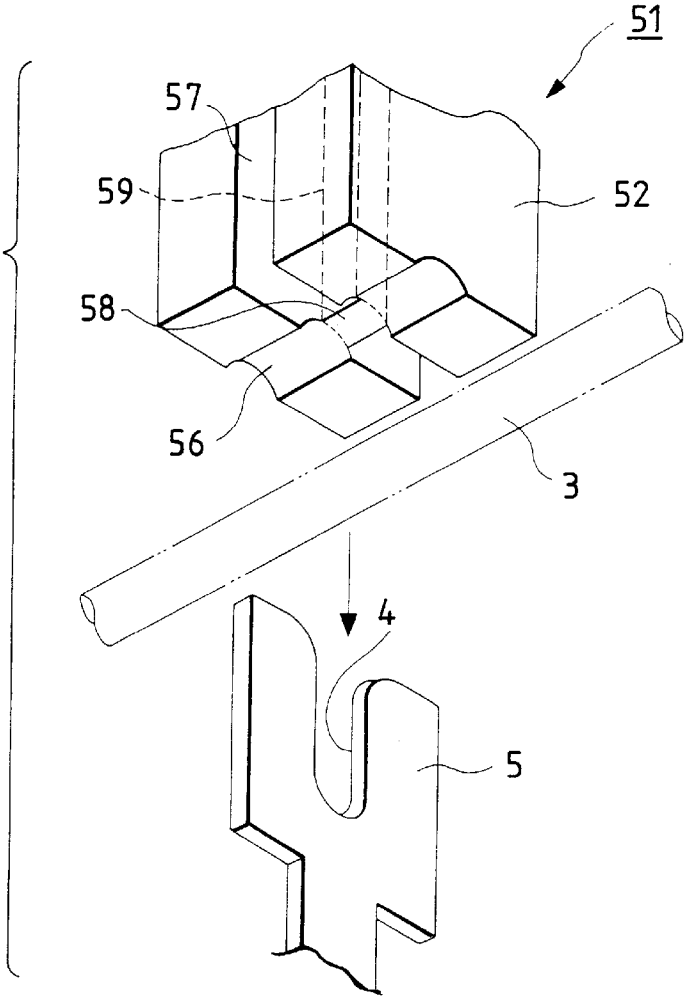
PRIOR ART FIG. 9
FIG. 9 is a perspective view of a conventional press-connecting tool.
Figure 10:
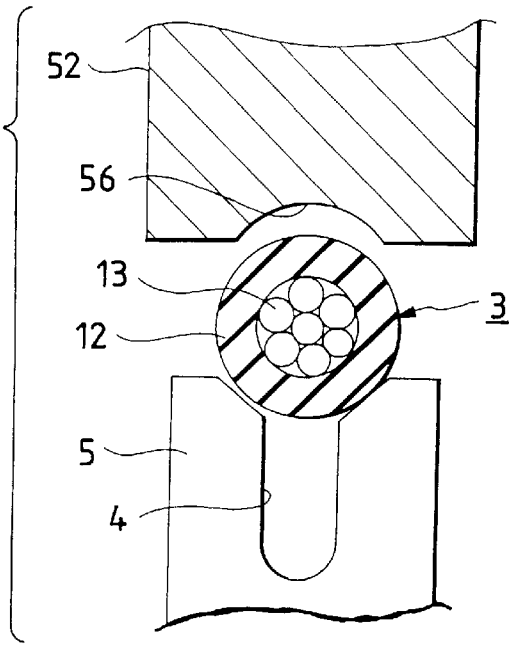
PRIOR ART FIG. 10
FIG. 10 is a view showing an intermediate stage of the press-connecting operation effected by the tool of FIG. 9.
Figure 11:
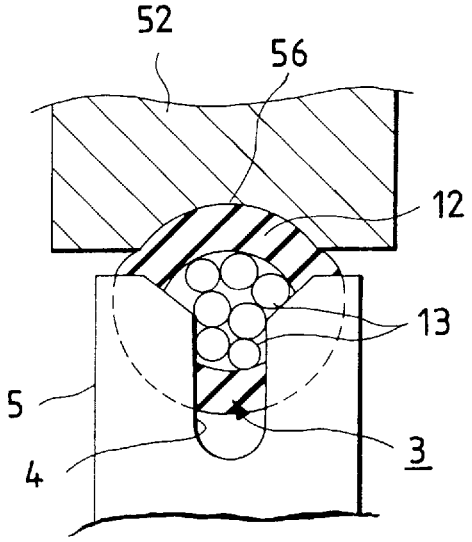
PRIOR ART FIG. 11
FIG. 11 is a view showing a laterally-crushed condition of a wire.

Preferred embodiments of press-connecting tools of the present invention will now be described in detail with reference to the drawings. FIG. 1 is a perspective view of the first embodiment of the press-connecting tool of the invention, FIG. 2 is a cross-sectional view showing the configuration of a wire pressing groove in the press-connecting tool of FIG. 1, FIG. 3 is a cross-sectional view showing the configuration of a modified wire pressing groove, FIG. 4 is a view showing an intermediate stage of the press-connecting operation in the embodiment of FIG. 1, FIG. 5 is a view showing a condition in which the press-connecting operation is completed in the embodiment of FIG. 1, FIG. 6 is a perspective view of a second embodiment of the press-connecting tool of the invention, FIG. 7 is a view showing an intermediate stage of the press-connecting operation in the embodiment of FIG. 6, and FIG. 8 is a view showing a condition in which the press-connecting operation is completed in the embodiment of FIG. 6.

As shown in FIG. 1, the press-connecting tool 1 includes a press-connecting die 2 which is movable in upward and downward directions, and a sheathed wire 3 and a press-connecting blade 5, having a slot 4 of a U-shaped contour, are arranged in a direction of press-connection of the press-connecting die 2.

More specifically, an arcuate pressing portion 6 of an arcuate cross-section is formed at that end of the press-connecting die 2 facing in the press-connecting direction, and extends along the length of the wire 3 to be pressed. A relief groove 7 for receiving the press-connecting blade 5 is formed in the press-connecting die, and is disposed perpendicularly to the arcuate pressing portion 6. The U-shaped slot 4 is adapted to fit on that portion of the arcuate pressing portion 6 intersecting the relief groove 7, and therefore a slot-fitting, arcuate pressing portion 8 of a narrower width is formed at this portion, and a support pillar 9, supporting this slot-fitting, arcuate pressing portion 8, is formed in the relief groove 7.

A pair of opposed crush prevention walls 11 and 11 depend from each of opposite ends of the arcuate pressing portion 6, and serve to prevent the wire 3 from being crushed laterally at the time of the press-connecting operation.

As shown in FIG. 2, the wire pressing groove 21 has a semi-circular shape, and a width W0 of the wire pressing groove 21 is equal to an outer diameter D of the wire 3, and a depth H0 of the wire pressing groove 21 is a half of the outer diameter D of the wire 3. In this case, each pair of crush prevention walls 11 and 11 are formed respectively at the lower edges of the arcuate pressing portion 6 in opposed relation to each other. Namely, the distance between the pair of crush prevention walls 11 and 11 is equal to the outer diameter of the wire.

As shown in FIG. 3, for example, the wire pressing groove may have a U-shaped cross-section such that a width W0 of its arc-shaped portion is equal to the outer diameter D of the wire 3 and that a depth H1 of the groove is larger than the outer diameter D of the wire 3. In this case, although each pair of crush prevention walls 11*a* and 11*a* are provided at a lower portion of the arcuate pressing portion 6 in opposed relation to each other, they do not always need to be parallel to each other, but may diverge toward the open end.

For effecting the press-connecting operation by the use of the above press-connecting tool, the wire 3 is first placed on the edge of the U-shaped slot 4 of the press-connecting blade 5, or on the surface of the wire pressing groove 21 of the press-connecting die 2 as shown in FIG. 4, and then the press-connecting die 2 and the press-connecting blade 5 are moved toward each other in the press-connecting direction.

Then, the wire 3 is pressed into the U-shaped slot 4 by the arcuate pressing portion 6, and therefore a sheath 12 is cut, so that a conductor 13 is brought into contact with the press-connecting blade 5, thereby press-connecting the wire 3 to the press-connecting blade 5, as shown in FIG. 5.

Since the press-connecting die 2 has the slot-fitting, arcuate pressing portion 8, the press-connected wire 3 will not become wavy in the longitudinal direction even if the relief groove 7 has a large width.

At the time of the press-connecting operation, the crush prevention walls 11, formed at the lower ends of the wire pressing groove 21, positively prevent the sheath 12 of the wire 3 from being laterally crushed in a direction perpendicular to the press-connecting direction, and the conductor 13 is prevented from becoming loose, thus preventing a large gap from being formed between the conductor 13 and the sheath 12, so that the good press-connecting condition is achieved. Therefore, the force of holding of the wire 3 on the press-connecting blade 5 is increased, and also the resistance of contact between the conductor 13 and the press-connecting blade 5 is made stable.

In the case where each pair of crush prevention walls 11*a* extend downwardly from the arcuate pressing portion 6 in such a manner that the distance between the pair of walls 11*a* is larger than the outer diameter D of the wire 3 as shown in FIG. 3 (that is, the depth H1 of the wire pressing groove 21*a* is larger than a half of the outer diameter D of the wire), the sheath 12 of the wire 3 is positively prevented from being laterally crushed in the direction perpendicular to the press-connecting direction, so that a good press-connecting condition is achieved. Therefore, the force of holding of the wire 3 on the press-connecting blade 5 is further increased, and also the resistance of contact between the conductor 13 and the press-connecting blade 5 is made more stable.

In the case where the opposed crush prevention walls 11*a* diverge toward the open end of the U-shaped portion as shown in FIG. 3, the press-connecting die 2*a* can be easily disengaged from the wire 3 after press-connecting the wire 3, and when the press-connecting die 2*a*, which offers a less disengagement resistance, is disengaged from the wire, the wire holding force will not be reduced.

The second embodiment of the press-connecting tool of the invention will now be described with reference to FIGS. 6 to 8. The press-connecting tool 31 of this embodiment shown in FIG. 6 differs from the above press-connecting tool 1 in that a wire reception portion 15, having an arcuate pressing portion 14 which can face a press-connecting die 2*b*, is provided at an intermediate portion of a U-shaped slot 4 in a press-connecting blade 5. Guide portions 16 for facilitating the insertion of the press-connecting blade 5 are formed at that end of a relief groove 7 in a press-connecting direction. The same portions as those of the first embodiment will be designated by the same reference numerals, respectively, and explanation thereof will be omitted.

Thus, the wire reception portion 15, having the arcuate pressing portion 14 which can face the press-connecting die 2*b*, is provided at the intermediate portion of the U-shaped slot 4 in the press-connecting blade 5, and with this construction the wire, pressed by crush prevention walls 11*b* in the press-connecting direction at the time of the press-connecting operation, is supported from the lower side, thereby maintaining the initial circular cross-section of the wire. Therefore, the press-connecting blade 5 and the conductor 13 are kept in good contact with each other, and also since the press-connecting height is constant, variations in the press-connecting position can be eliminated.

Since the guide portions 16 for facilitating the insertion of the press-connecting blade 5 are formed at that end of the relief groove 7 facing in the press-connecting direction, the width T2 of the relief groove 7 can be reduced to be close to the thickness T1 of the press-connecting blade 5. Specifically, it is preferred that the groove width T2 be equal to the thickness T1 of the press-connecting blade 5 plus not more than about 0.3 mm. Therefore, the slot-fitting, arcuate pressing portion 8 and the support pillar 9 are able to be omitted, and the formation of the press-connecting die 2*b* is easier, and the manufacturing cost for the press-connecting tool can be reduced.

In the case where the support pillar 9 is not provided, it is preferred that the width T2 of the relief groove 7 be as close to the width T1 of the press-connecting blade 5 as possible, thereby reducing a gap therebetween.

For effecting the press-connecting operation by the use of the above press-connecting tool, the wire 3 is first placed on the edge of the U-shaped slot 4 of the press-connecting blade 5, or on a surface of a wire pressing groove 21*b* of the press-connecting die 2*b* as shown in FIG. 7, and then the press-connecting die 2*b* and the press-connecting blade 5 are moved toward each other in the press-connecting direction.

Then, the wire 3 is pressed into the U-shaped slot 4 by an arcuate pressing portion 6, and therefore a sheath 12 is cut, so that the conductor 13 is brought into contact with the press-connecting blade 5, thereby press-connecting the wire 3 to the press-connecting blade 5, as shown in FIG. 8.

At this time, the crush prevention walls 11*b*, forming the wire pressing groove 21*b* which is deeper than a half of the outer diameter of the wire, positively prevent the sheath 12 of the wire 3 from being laterally crushed in a direction perpendicular to the press-connecting direction, and when the wire is press-connected into a predetermined position, the lower portion of the wire 3 is brought into contact with the arcuate pressing portion 14 of the wire reception portion 15. As a result, the sheath 12 of the wire 3, pressed by the crush prevention walls 11*b* in the press-connecting direction, is supported from the lower side, thereby maintaining the initial circular cross-section of the wire.

Therefore, the conductor 13 is prevented from becoming loose, and the good press-connecting condition is achieved, and since the press-connecting height is constant, variations in the press-connecting position can be eliminated. Therefore, the force of holding of the wire 3 on the press-connecting blade 5 is further increased, and also the resistance of contact between the conductor 13 and the press-connecting blade 5 is made more stable.

The present invention is not to be limited to the above embodiments, and various modifications can be made. For example, in the above embodiments, although the press-connecting die cooperates with the single press-connecting blade 5, there can be provided an arrangement in which a plurality of press-connecting die are used in combination with a plurality of press-connecting blades 5 juxtaposed on a board.

As described above, in the above press-connecting tools of the present invention, the pair of opposed crush prevention walls for preventing the wire from being crushed in the press-connecting direction during the press-connecting operation extend downwardly from each of the opposite lower ends of the arcuate pressing portion, and the crush prevention walls and the arcuate pressing portion, which jointly form the wire pressing groove for receiving the wire, can contact the sheath of the wire at least over a half of the outer peripheral length of the sheath.

Therefore, during the press-connecting operation, the sheath of the wire is positively prevented from being crushed in a direction perpendicular to the press-connecting direction, and the conductor of the wire will not become loose, thus achieving the good press-connecting condition. Therefore, the force of holding of the wire on the press-connecting blade is increased, and also the resistance of contact between the conductor and the press-connecting blade is made stable, so that the highly-reliable press-connection can be obtained.

The distance between the lower ends of the pair of opposed crush prevention walls is substantially equal to the outer diameter of the wire, and the depth of the wire pressing groove is not less than a half of the outer diameter of the wire. Therefore, the wire can closely fit in the wire pressing groove, and during the press-connecting operation, the wire sheath is positively prevented from being crushed in a direction perpendicular to the press-connecting direction.

Therefore, the conductor will not become loose, and therefore a gap will not develop between the sheath and the conductor, thus achieving the good press-connecting condition. Therefore, the wire holding force is further increased, and the resistance of contact between the conductor and the press-connecting blade is made more stable.

The distance between the lower ends of the pair of opposed crush prevention walls is larger than the outer diameter of the wire, and the depth of the wire pressing groove is larger than a half of the outer diameter of the wire. Therefore, the press-connecting die can be easily disengaged from the wire after the press-connecting operation, and therefore the reduction of the wire holding force due to this disengagement resistance is prevented.

The wire reception portion is provided at an intermediate portion of the slot in the press-connecting blade, and the wire reception portion has the arcuate pressing portion which can face the press-connecting die. Therefore, the deformation of the wire in the press-connecting direction during the press-connecting operation is suppressed, and therefore the press-connecting blade and the conductor are kept in good contact with each other, and also the conductor is prevented from becoming loose.

The guide portions for facilitating the insertion of the press-connecting blade into the relief groove in the press-connecting die are formed at that end of the relief groove facing in the press-connecting direction. Therefore, the width of the relief groove can be decreased to reduce the gap between the press-connecting blade and the relief groove, and besides the provision of the slot-fitting is able to be omitted, and the manufacturing cost for the press-connecting tool can be reduced.

What is claimed is:

1. A press-connecting tool for electrically connecting a press-connecting blade having a U-shaped slot with a wire, the press connecting tool comprising:

a press-connecting die having two die portions each including a substantially planar surface;

an arcuate pressing portion formed on a surface of the press-connecting die facing in a press-connecting direction, a longitudinal length of the arcuate pressing portion corresponding to a longitudinal length of the wire; and a pair of opposed crush prevention walls, for preventing the wire from being crushed in the press-connecting direction, extending from each end of the arcuate pressing portion, wherein a relief groove, for receiving the press-connecting blade, is formed adjacent to the arcuate pressing portion and defined directly between the planar surfaces of the pair of opposed crush prevention walls, the die portions symmetrically disposed about the relief groove, wherein the wire is pressed into the U-shaped slot of the press-connecting blade by the arcuate pressing portions when the press-connecting die and the press-connecting blade are moved toward each other in the press-connecting direction, and wherein a wire pressing groove is defined by the crush prevention walls and a portion of the arcuate pressing portions adjacent to the crush prevention walls, the wire pressing groove contacting at least a half of an outer peripheral surface of the sheath.

2. The press-connecting tool of claim 1, wherein a distance between ends of the opposed crush prevention walls is substantially equal to an outer diameter of the wire, and a depth of the wire pressing groove is at least half of the outer diameter of the wire.

3. The press-connecting tool of claim 1, wherein a distance between the opposed crush prevention walls at a proximal portion is substantially equal to an outer diameter of the wire, wherein a distance between ends of the opposed crush prevention walls is larger than an outer diameter of the wire, and wherein a depth of the wire pressing groove is larger than a half of the outer diameter of the wire.

4. The press-connecting tool of claim 1, wherein the press-connecting blade includes a wire reception portion at an intermediate portion of the U-shaped slot, and wherein the wire reception portion has an arcuate pressing portion which faces the press-connecting die.

5. The press-connecting tool of claim 1, wherein guide portions, for facilitating the insertion of the press-connecting blade into the relief groove in the press-connecting die, are formed at end of the relief groove facing in the press-connecting direction.

6. The press-connecting tool of claim 1, wherein the arcuate pressing portion includes a slot fitting portion formed between the pair of opposed crush prevention walls.

7. A press-connecting tool for electrically connecting a press-connecting blade having a U-shaped slot with a wire, the press connecting tool comprising:

a press-connecting die having two die portions each including a substantially planar surface;

an arcuate pressing portion formed on a surface of the press-connecting die facing in a press-connecting direction, a longitudinal length of the arcuate pressing portion corresponding to a longitudinal length of the wire; and a pair of opposed crush prevention walls, for preventing the wire from being crushed in the press-connecting direction, extending from each end of the arcuate pressing portion, wherein a relief groove, for receiving the press-connecting blade, is formed adjacent to the arcuate pressing portion and is defined directly between the planar surfaces of the pair of opposed crush prevention walls, the die portions symmetrically disposed about the relief groove, wherein the wire is pressed into the U-shaped slot of the press-connecting blade by the arcuate pressing portions when the press-connecting die and the press-connecting blade are moved toward each other in the press-connecting direction, and wherein a wire pressing groove is defined by the crush prevention walls and a portion of the arcuate pressing portions adjacent to the crush prevention walls, a depth of the wire pressing groove being at least half a width of the wire pressing groove.

8. The press-connecting tool of claim 7, wherein a distance between ends of the opposed crush prevention walls is substantially equal to an outer diameter of the wire, and a depth of the wire pressing groove is at least half of the outer diameter of the wire.

9. The press-connecting tool of claim 7, wherein a distance between the opposed crush prevention walls at a proximal portion is substantially equal to an outer diameter of the wire, wherein a distance between ends of the opposed crush prevention walls is larger than an outer diameter of the wire, and wherein a depth of the wire pressing groove is larger than a half of the outer diameter of the wire.

10. The press-connecting tool of claim 7, wherein the press-connecting blade includes a wire reception portion at an intermediate portion of the U-shaped slot, and wherein the wire reception portion has an arcuate pressing portion which faces the press-connecting die.

11. The press-connecting tool of claim 7, wherein guide portions, for facilitating the insertion of the press-connecting blade into the relief groove in the press-connecting die, are formed at end of the relief groove facing in the press-connecting direction.

12. The press-connecting tool of claim 7, wherein the arcuate pressing portion includes a slot fitting portion formed between the pair of opposed crush preventing walls.

* * * * *